United States Patent [19]

Korte

[11] 3,958,716

[45] May 25, 1976

[54] REGULATOR GAGE GUARD

[76] Inventor: Russell J. Korte, 79401 McKay, Romeo, Mich. 48065

[22] Filed: Apr. 18, 1975

[21] Appl. No.: 569,585

[52] U.S. Cl. ..... 220/85 P; 137/382

[51] Int. Cl.[2] ..... B65D 25/00

[58] Field of Search ..... 220/85 P, 372, 320; 98/122; 137/382, 377; 222/182

[56] References Cited

UNITED STATES PATENTS

| | | | |
|---|---|---|---|
| 975,725 | 11/1910 | Shapiro | 220/372 |
| 1,887,119 | 11/1932 | Cornell, Jr. | 220/372 |
| 2,337,960 | 12/1943 | Anderson | 220/85 P |
| 2,825,276 | 3/1958 | Porter | 230/372 |
| 2,946,223 | 7/1960 | Cauer, Jr. | 137/382 |
| 3,406,708 | 10/1968 | Maydock | 137/382 |
| 3,515,305 | 6/1970 | Weber et al. | 220/372 |
| 3,648,885 | 3/1972 | Kitsuda | 220/85 P |

*Primary Examiner*—George E. Lowrance
*Assistant Examiner*—Allan N. Shoap
*Attorney, Agent, or Firm*—Thomas N. Young

[57] ABSTRACT

A guard for oxy-acetylene regulator gages comprising a circular clamp ring which may be secured around the regulator body and a rigid metal band which projects upwardly from the clamp ring to enclose the gages.

2 Claims, 3 Drawing Figures

REGULATOR GAGE GUARD

This invention comprises a protective guard apparatus for multi-gas regulator and gage assembly.

BACKGROUND OF THE INVENTION

It is common for accidental damage to be inflicted upon the regulator body and or gages of a gas mixing regulator assembly such as one finds on an oxy-acetylene welding set. A typical regulator-gage assembly comprises a round regulator body having fittings for connection to the two gases to be mixed and a pair of gas pressure gages mounted on the regulator body and extending radially therefrom. The gages are relatively delicate devices and are extremely vulnerable to accidental damage by virtue of their extended disposition relative to the gas bottles and the regulator body.

The object of this invention is to provide a guard assembly which may be quickly and easily attached to a regulator-gage assembly so as to prevent much or all of the accidental injury and damage which might otherwise occur to the regulator-gage assembly.

Moreover, it is a further object of the invention to provide a regulator-gage guard the installation of which does not require the drilling and tapping of holes into the regulator body and which further does not typically require the removal and replacement of any screws, bolts, or other fasteners which might be part of the regulator assembly.

BRIEF SUMMARY OF THE INVENTION

The subject invention comprises the substantially integral combination of a clamp ring which is circular or substantially circular in configuration in the typical case and is adapted for disposition about the regulator body, adjustor means such as an adjustment screw between the two terminal ends of the ring for tightening and loosening the ring on the regulator body, and rigid guard means which are secured to the ring and extend therefrom in such a fashion as to define a semienclosed area sufficient to accommodate one or more gages extending radially from the regulator body.

In the preferred embodiment the guard means comprises a curved band of flat metal stock and a metal screen welded thereto; however, the guard means may take any of a variety of forms as hereinafter described in greater detail.

DETAILED DESCRIPTION OF THE SPECIFIC EMBODIMENT

Figure 1:
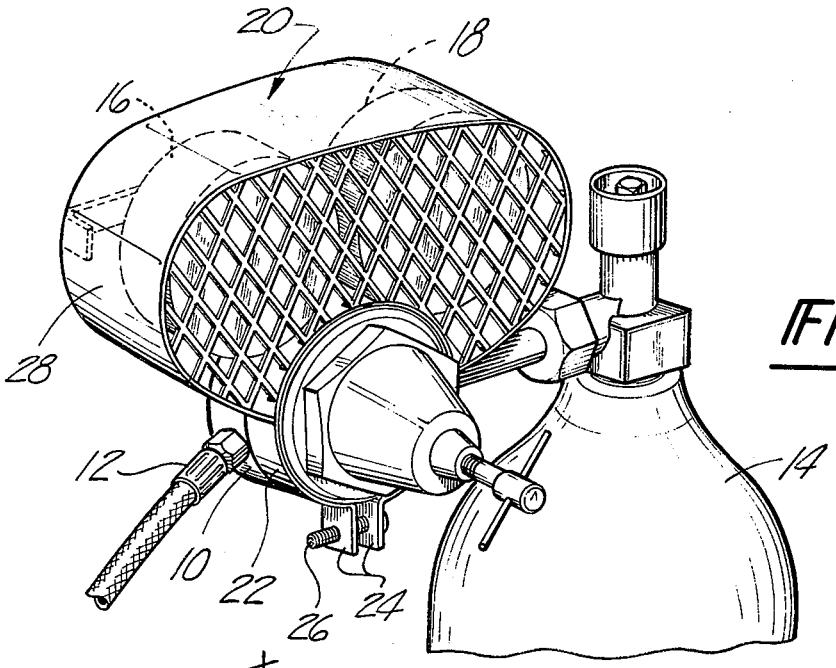
FIG. 1 is a perspective view of a regulator-gage guard assembly in place on a cylindrical regulator body having twin gages.
Figure 2:
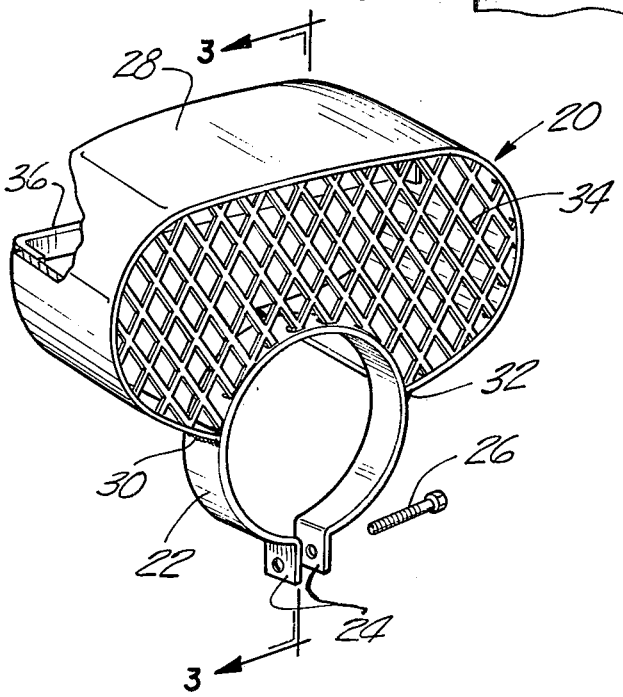
FIG. 2 is a perspective view of the regulator-gage guard alone.

FIG. 1 shows a substantially cylindrical multi-gas regulator 10 the body of which is provided with the fittings to receive inlet lines 12 from a pair of gas bottles, one of which is represented at 14. The regulator 10 functions to mix the gases for application to a common outlet point as will be apparent to those familiar with gas welding apparatus. Regulators of this type are typically used in oxy-acetylene welding apparatus and may be purchased from the Victor Equipment Co. of Denton, Texas.

To monitor the pressures of the two inlet gases, pressure gages 16 and 18 are mounted on the regulator body 10 so as to project radially therefrom in the fashion of "mouse ears". In this position, both the regulator body and, especially, the gages 16 and 18 are extremely vulnerable to accidental damage.

To protect gages 16 and 18 as well as regulator 10, a guard 20 is removably secured to the regulator body so as to surround and generally encompass the gages 16 and 18 with a rigid protective shield as hereinafter described.

Guard 20 comprises a circular clamp ring 22 which is adapted to fit around the periphery of the cylindrical regulator body 10. Clamp ring 22 has terminal ends 24 bent into parallel orientation and having holes drilled therein to receive an adjustor screw 26. One of the holes is untapped to freely accept the screw while the other hole is tapped for threaded engagement with screw 26 such that the spacing between the terminal ends 24 might be easily adjusted to tighten and loosen the clamp ring 22 about the regulator body 10. A nut may be welded to one of the terminal ends as a substitute for the tapping operation if desired.

Guard 20 further comprises rigid guard means 28 in the form of a flat band of rigid metal stock bent into a semi-enclosed configuration with the opposite ends thereof welded to the clamp ring 22 at spaced points 30 and 32 as shown. Guard band 28 is of sufficient dimension as to provide an area or volume which substantially encloses and surrounds the gages 16 and 18 as best shown in FIG. 1.

Figure 3:
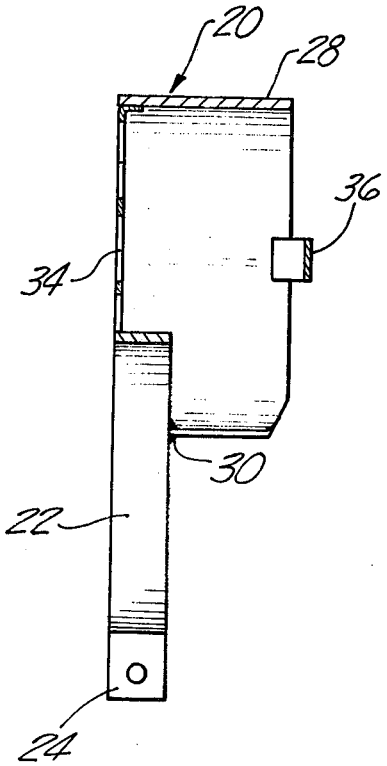
FIG. 3 is a side sectional view of the guard.

The guard means further comprises an expanded metal mesh screen 34 which is coextensive with the protected area over one face thereof and has the peripheral ends bent back and welded around the inner periphery of band 28 as best shown in FIG. 3. The holes in the screen 34 permit the gage faces to be viewed therethrough. Thus, the clamp ring 22, band 28, and the mesh screen 34 comprise a substantially integral unit having great structural strength and durability.

The gages 16 and 18 are protected from the rear by a bar 36 which extends fully across the guard band 28 and is welded to the sides thereof as shown. This bar is optional.

The enclosing portion of gage guard 20 may, of course, take a variety of forms including rigid wire forms as well as the flat metal stock which is shown in the drawings. Moreover, while the expanded metal mesh 34 is believed to provide good protection, one may substitute a more open structure such as one or more parallel metal bars or wires extending across the face of the gage protector and welded to the frame 28 as described. Many other structural modifications will occur to those skilled in the art.

By way of illustration, the frame 28 may be formed of 14-gage steel approximately two and one-half inches wide while the ring 22 may be made of one-eighth inch soft steel. The typical clamp ring is approximately four inches in diameter and has been found to fit perfectly over the cylindrical body of a Victor oxy-acetylene regulator.

The embodiments of the invention in which an exclusive property or privilege is chemical is claimed are defined as follows:

1. A gage guard for regulator-gage assemblies of the type including a regulator having a cylindrical body and a plurality of indicator gages mounted on the body and projecting radially therefrom in circumferentially spaced disposition, said gage guard comprising: a guard band of rigid, breakage-resistant material formed into an elongated loop with the ends thereof spaced apart, said loop being of such size as to accommodate therein said indicator gages such that the gages are substantially enclosed by the band, a clamp ring adapted for disposition about the regulator body, adjustor means for tightening and loosening the ring about the body, the terminal ends of the guard band being secured to the clamp ring at spaced points on the ring such that a minor portion of the ring projects partially into the loop between the terminal ends thereof but the major portion of the clamp ring including the adjustor means extends outside of the interior of the guard band such that when the clamp ring is installed on the regulator body, the guard band encloses an area radially outwardly of the regulator body, and a protective grid secured to the guard band adjacent an edge thereof so as to protect the faces of said gages.

2. Apparatus as defined in claim 1 further comprising a protective bar extending between oppositely spaced points on said guard band adjacent the other edge thereof to protect the rear surfaces of the gages when installed thereover.

* * * * *